US005179317A

United States Patent [19]

Watanabe et al.

[11] Patent Number: 5,179,317

[45] Date of Patent: Jan. 12, 1993

[54] FLUORESCENT LUMINOUS DEVICE HAVING A VIBRATION ABSORBING ELEMENT

[75] Inventors: Hiroshi Watanabe; Yukihiko Shimizu; Masao Saito, all of Mobara, Japan

[73] Assignee: Futaba Denshi Kogyo K.K., Mobara, Japan

[21] Appl. No.: 663,175

[22] Filed: Mar. 1, 1991

[30] Foreign Application Priority Data

Mar. 8, 1990 [JP] Japan ..... 2-055112

[51] Int. Cl.[5] ..... H01J 19/12

[52] U.S. Cl. ..... 313/496; 313/269; 313/278; 313/279

[58] Field of Search ..... 313/278, 279, 269, 496, 313/497, 422, 446

[56] References Cited

U.S. PATENT DOCUMENTS 3,917,968 11/1975 DiBenedetto ..... 313/278

4,259,613 3/1981 DuBois ..... 313/497

4,812,716 3/1989 Miyama et al. ..... 313/269

5,016,873 10/1991 Belliveau ..... 313/269

FOREIGN PATENT DOCUMENTS 0072159 6/1977 Japan ..... 313/497

*Primary Examiner*—Donald J. Yusko

*Assistant Examiner*—N. D. Patel

*Attorney, Agent, or Firm*—Oblon, Spivak, McClelland, Maier & Neustadt

[57] ABSTRACT

A fluorescent luminous device capable of permitting vibration of a filamentary cathode due to any external vibration or shock transmitted thereto to be readily attenuated, to thereby substantially prevent flickering of a display due to a variation in luminance of the luminous section, resulting in improving quality of the display. A part of a vibration adsorbing element provided at the end of a filamentary cathode is separatably contacted with the fixed portion of an envelope in which the element and cathode are arranged.

6 Claims, 2 Drawing Sheets

FLUORESCENT LUMINOUS DEVICE HAVING A VIBRATION ABSORBING ELEMENT

BACKGROUND OF THE INVENTION

This invention relates to a fluorescent luminous device adapted to cause a phosphor to emit light upon impingement of electrons emitted from a filamentary cathode thereon, and more particularly to a fluorescent luminous device used as a display device for various electronic equipment, an instrument panel, a clock, an amusement equipment and the like, as well as a light source such as a luminous cell, a back light or the like which serves as a luminous display unit for a large-scale display equipment.

In general, a fluorescent luminous device includes phosphor deposited anodes and a cathode arranged in an envelope evacuated to a high vacuum so as to serve as a luminous display section and an electron source, respectively.

SUMMARY OF THE INVENTION

It is an object of the present invention to provide a fluorescent luminous device including a vibration-proof structure for preventing vibration of a filamentary cathode which structure is arranged in a manner not to hinder a display of the luminous device and cause undesired phenomena such as a display defect and the like.

In accordance with the present invention, a fluorescent luminous device is provided which comprises:

- a vacuum envelope including a substrate and side plates and a front cover sealedly fixed on the substrate;
- the substrate, side plates and front cover being made of an insulating material;
- phosphor deposited anodes arranged on the substrate so as to serve as a luminous display section;
- a filamentary cathode;
- a cathode supporter arranged on both end sides of the substrate and adapted to support the filamentary cathode thereon so as to stretchedly arrange the filamentary cathode above the luminous display section; and
- a vibration absorbing element held on the filamentary cathode and positioned in proximity to one end of the filamentary cathode in a manner to be movable in the longitudinal direction of the filamentary cathode and rotatable about said filamentary cathode;
- the vibration absorbing element being formed of a strip-like metal material;
- the vibration absorbing element being folded at one end thereof to form a folded portion through which the vibration absorbing element is held on the filamentary cathode and obliquely extending at the other end thereof to the substrate so as to be contactable with the substrate.

In the fluorescent luminous device of the present invention constructed as described above, the vibration of the filamentary cathode is transmitted to the vibration absorbing element provided on the filamentary cathode to vibrate the element. A part of the vibration absorbing element is movable with respect to the fixed portion of the envelope, to thereby repeat the contacting and separating with respect to the fixed portion of the envelope. This causes the vibration energy of the filamentary cathode to be reduced, resulting in the vibrational energy of the filamentary cathode being attenuated.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, a fluorescent luminous device according to the present invention will be described hereinafter with reference to the accompanying drawings.

Figure 1:
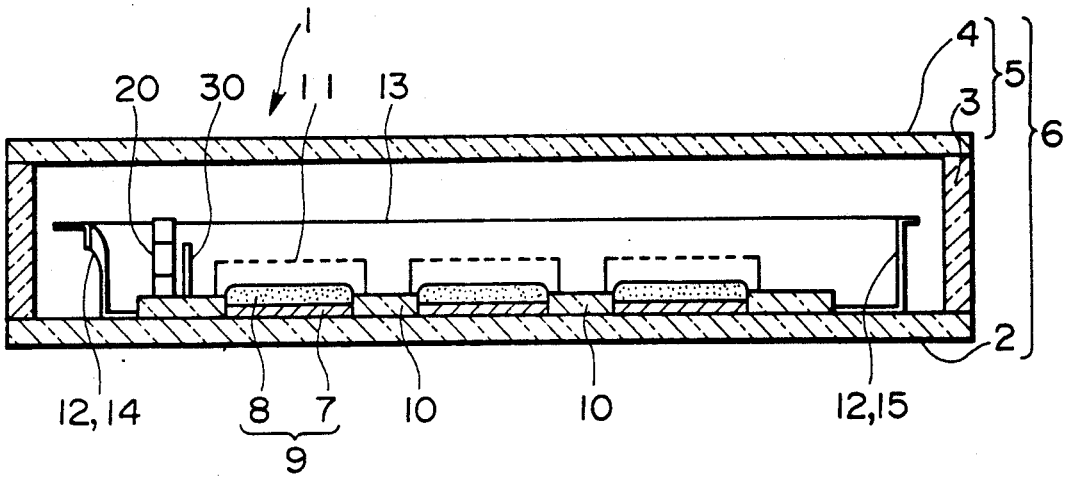
FIG. 1 is a sectional view showing a first embodiment of a fluorescent luminous device according to the present invention.
Figure 2:
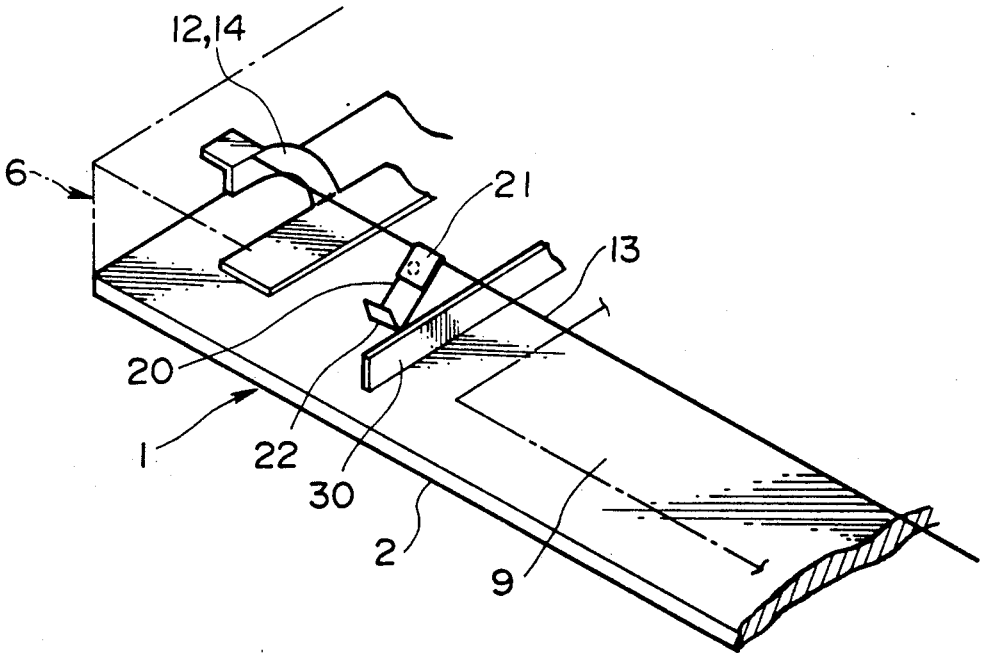
FIG. 2 is a fragmentary perspective view showing an essential part of the fluorescent luminous device of FIG. 1.

FIGS. 1 and 2 illustrate a first embodiment of a fluorescent luminous device according to the present invention.

A fluorescent luminous device of the illustrated embodiment generally designated at reference numeral 1 includes a substrate 2 made of an insulating material such as glass or the like and a casing 5 assembled of side plates 3 and a front cover 4 each likewise made of an insulating material such as glass or the like. The casing 5 is sealedly fixed on the substrate 2, resulting in an envelope 6 of a box-like shape being provided. The envelope 6 is evacuated to a high vacuum and various elements such as electrodes and the like are arranged in the envelope 6. On the substrate 2 are arranged anode conductors 7 and wiring conductors (not shown), and the anode conductors 7 each have a phosphor 8 deposited thereon, resulting in providing anodes 9 serving as a luminous display section. Also, on the substrate 2 is arranged an insulating layer 10 in a manner to separately surround the anodes 9. Above each of the anodes 9 is arranged a control electrode 11.

Also, the fluorescent luminous device of the first embodiment includes a cathode supporter 12 for supporting both ends of a filamentary cathode 13 thereon so as to stretchedly arrange it above the control electrodes 11. In the illustrated embodiment, the cathode supporter 12 comprises an anchor 14 arranged on the substrate 2 so as to support one end of the filamentary cathode 13 thereon and exhibiting elasticity so as to act as an elastic support member and a support 15 arranged at the other end of the filamentary cathode 13 so as to support the other end of the filamentary cathode 13 thereon and serving as a fixing support member, so that the filamentary cathode 13 is stretchedly arranged while tension of a predetermined magnitude is constantly applied thereto.

The fluorescent luminous device of the illustrated embodiment also includes a vibration absorbing element 20 arranged in proximity to the anchor 14 in the envelope 6 for supporting the one end of the filamentary cathode 13. The vibration absorbing element 20 functions to transmit vibration of the filamentary cathode 13 to the outside thereof, therefore, it is required to exhibit mass corresponding to a certain degree to that of the filamentary cathode 13 vibrating and rigidity sufficient to endure the vibration, as well as heat resistance sufficient to endure a temperature of the filamentary cathode heated. In view of the foregoing, in the illustrated embodiment, the vibration absorbing element 20 is made of a 426 alloy material (42% Ni, 6% Cr, 52% Fe) formed into a strip-like shape which is widely used in vacuum devices because it has a coefficient of thermal expansion which is equivalent to glass.

More particularly, the vibration absorbing element 20, as shown in FIG. 2, is provided at one end thereof with a guide section 21 which is formed by folding one end of the strip-like material and through which the vibration absorbing element 20 is held on the filamentary cathode 13 and guided along the filamentary cathode. The guide section 21 is then fixed in a ring-like manner. More particularly, the vibration absorbing element 20 is constructed so as to be movable in the longitudinal direction of the filamentary cathode 13 and rotatable about it through the guide section 21. Also, the vibration absorbing element 20 includes a turning section 22 formed by bending the other end of the strip-like material while rounding the bent portion. The so-constructed vibration absorbing element 20 is obliquely arranged with respect to the substrate 2 while being contacted at the turning section 22 with the substrate 2.

Further, the fluorescent luminous device of the illustrated embodiment includes a stopper member 30 arranged between the vibration absorbing element 20 and the anodes 9 so as to prevent the vibration absorbing element 20 from moving toward the anodes 9, to thereby prevent the element 20 from hindering a display by the anodes 9.

Now, the manner of operation of the illustrated embodiment constructed as described above will be described hereinafter.

When any external vibration or shock is applied to the fluorescent luminous device to cause the filamentary cathode to vibrate, the guide section 21 of the vibration absorbing element 20 is contacted with the filamentary cathode 13 kept free with respect to the guide section 21, so that the vibration of the filamentary cathode 13 is positively transmitted to the vibration absorbing element 20 irrespective of the direction of vibration. The vibration absorbing element 20, as described above, is arranged so as to be freely movable with respect to the filamentary cathode 13, so that the transmission of vibration from the filamentary cathode 13 to the vibration absorbing element 20 causes vibration of the turning section 22, resulting in the turning section 22 repeating intermittent contacting with the substrate 2. The movement of the vibration absorbing element 20 and the abutment or sliding of the vibration absorbing element 20 with respect to the substrate 2 which are thus carried out cause the vibrational energy to be consumed, so that the vibration of the filamentary cathode 13 may be rapidly attenuated.

During the process of attenuating the vibration, even when the vibration absorbing element 20 is to move along the filamentary cathode 13 toward the anodes 9, it abuts against the stopper member 30 to fail to further move, so that the disadvantage that the vibration absorbing element 20 hinders a luminous display by the anodes 9 may be effectively eliminated.

In the first embodiment described above, the substrate 2 is placed down, therefore, the vibration absorbing element 20 is abutted against the substrate 2. However, the embodiment may be constructed in such a manner that the substrate 2 is placed up, wherein the vibration absorbing element 20 is abutted against the inner surface of the front cover 4. In this instance, the bent portion of the turning section 22 may be further rounded in order to permit the vibration absorbing element 20 to be lubricously contacted with the front cover 4.

Also, in the illustrated embodiment, the vibration absorbing element 20 is mounted through the guide section 21 on the filamentary cathode 13 so as to be movable with respect to the cathode, accordingly, the vibration absorbing element 20 may be contacted with one of the substrate 2 and front cover 4 depending upon the orientation or direction of the substrate 2. However, when the arrangement of the envelope 6 is carried out in a predetermined manner, the embodiment may be so constructed that the vibration absorbing element 20 is fixed on the filamentary cathode 13 and a part of the vibration absorbing element 20 is contacted with a predetermined fixed portion of the envelope 6. However, in this instance as well, the vibration absorbing element is required to be constructed so as to permit the part of the vibration absorbing element contacted with the fixed portion to be moved with vibration and repeatedly abutted against the fixing portion, resulting in the vibrational energy being consumed.

In the illustrated embodiment, the vibration absorbing element 20 is formed of a ribbon-like material. However, it may be formed of a wire-like material so long as it provides the element 20 with a certain degree of rigidity and mass. Also, in the embodiment, the vibration absorbing element, 20 is made of 426 alloy. However, it may be formed of a sheet of metal such as stainless steel, nickel alloy or the like. Alternatively, it may be made of a ceramic material formed into a sheet-like shape.

Figure 3:
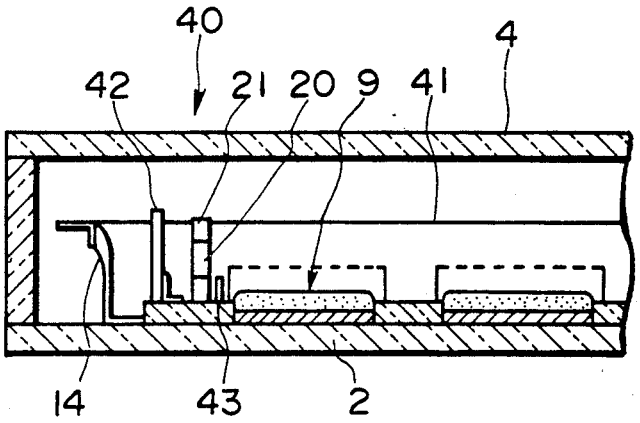
FIG. 3 is a sectional view showing a second embodiment of a fluorescent luminous device according to the present invention.

Now, a second embodiment of a fluorescent luminous device according to the present invention will be described with reference to FIG. 3.

A fluorescent luminous device of the second embodiment generally designated at reference numeral 40 includes a filamentary cathode 41 formed into a length larger than that in the first embodiment described above. The filamentary cathode 41 of such an increased length generally fails to permit a single anchor as used in the first embodiment to effectively absorb elongation of the filamentary cathode 41 occurring when it is heated. In order to solve the problem, the second embodiment uses a pair of anchors 14 for a cathode supporter.

Unfortunately, when the filamentary cathode 41 is supported at both ends thereof by means of the anchors 14 exhibiting elasticity, the position of the filamentary cathode 41 is stretched ant thus is made unstable. Also, the supporting of both ends of the filamentary cathode 41 by the elastic anchors 14 causes another disadvantage of failing to effectively attenuate vibration of the filamentary cathode 41 due to application of any external vibration or shock thereto, resulting in the vibration significantly continuing. In view of these disadvantages, the second embodiment is constructed in such a manner that a pair of guide plates 42 made of a ceramic material are provided on a substrate 2 in a manner to be in proximity to both ends of the filamentary cathode 41, to thereby support and position the filamentary cathode 41 thereon. A vibration absorbing element 20 is arranged so as to be positioned inside each of the guide plates 42 or between each of the guide plates 42 and the anodes 9 and a stopper member 43 is positioned inside each of the vibration absorbing elements 20 or between each of the elements 20 and the anodes 9. Thus, in the second embodiment, the guide plates 42, vibration absorbing elements 20 and stopper members 43 are arranged on both end sides of the filamentary cathode 41, to thereby solve the above-described problems due to the arrangement of the anchors 14 on both sides of the filamentary cathode 41. The remaining part of the second embodiment may be constructed in substantially the same manner as the first embodiment described above.

The above-described construction of the second embodiment positively attenuates vibration of the filamentary cathode arranged in the fluorescent luminous device even when it has an increased length.

Each of the fluorescent luminous devices 1 and 40 of the embodiments described above is adapted to permit light emitted from the anodes 9 to be observed through the front cover 4. However, the present invention may be likewise applied to a fluorescent luminous device of the type wherein light emitted from anodes is observed through a substrate and anode conductors.

Figure 4:
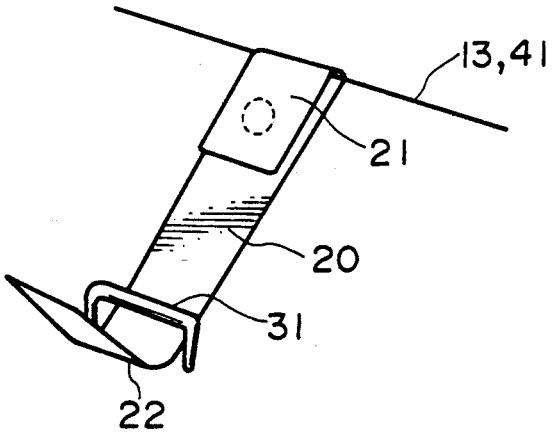
FIG. 4 is a perspective view showing another manner of a stopper member used in the present invention.

Also, in each of the above-described embodiments, the stopper member 30 formed into a wall-like shape. However, the stopper member may be constructed in such a manner as shown in FIG. 4. More particularly, a stopper member designated reference numeral 31 in FIG. 4 is formed into a fence-like shape or substantially U-shape so as to surround the distal end portion of a vibration absorbing element 20. Such configuration of the stopper member 31 permits rotation and lengthwise movement of the vibration absorbing element 20 with respect to a filamentary cathode 13 or 41 to be carried out within a predetermined range, to thereby effectively prevent the element 20 from interfering with various electrodes arranged in an envelope.

As can be seen from the foregoing, the fluorescent luminous device of the present invention is so constructed that a part of the vibration absorbing element provided at the end of the filamentary cathode is separatably contacted with the fixed portion of the envelope. Such construction permits vibration of the filamentary cathode due to any external vibration or shock transmitted thereto to be readily attenuated, to thereby substantially prevent flickering of a display due to a variation in luminance of the luminous section. Such a decrease in variation of the luminance improves quality of the display. Also, the arrangement of the vibration absorbing element at the end of the filamentary cathode in the present invention effectively prevents the element from hindering the display, resulting in eliminating any display defect.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fluorescent luminous device comprising:

a vacuum envelope including a substrate, side plates and a front cover sealedly fixed on said substrate;

said substrate, side plates and front cover being made of an insulating material;

phosphor deposited anodes arranged on said substrate so as to serve as a luminous display section;

a filamentary cathode;

a cathode supporter arranged on opposite ends of said substrate and adapted to support said filamentary cathode thereon so as to stretchedly arrange said filamentary cathode above said luminous display section; and a vibration absorbing element movably supported on said filamentary cathode and positioned in proximity to one end of said filamentary cathode for permitting a movement of said vibration absorbing element in a longitudinal direction of said filamentary cathode and permitting a rotation of said vibration absorbing element about said filamentary cathode;

said vibration absorbing element being formed of a strip-like metal material;

said vibration absorbing element being folded at one end thereof to form a folded portion through which said vibration absorbing element is movably supported on said filamentary cathode and obliquely extending at the other end thereof to said substrate for intermittently contacting said substrate.

2. A fluorescent luminous device as defined in claim 1, further comprising a stopper member arranged on a portion of said substrate near said anodes based on the position of said substrate on which said vibration absorbing element is arranged so as to prevent movement of said vibration absorbing element.

3. A fluorescent luminous device as defined in claim 1, wherein at least a part of said cathode supporter comprises an elastic support member for applying tension to said filamentary cathode; and further comprising a guide member arranged inside said elastic support member for positioning said filamentary cathode;

said vibration absorbing element being arrange inside said guide member.

4. A fluorescent luminous device as defined in claim 3, wherein said guide member is made of a ceramic material.

5. A fluorescent luminous device as defined i claim 2, wherein said stopper member is formed into a wall-like shape.

6. A fluorescent luminous device as defined in claim 2, wherein said stopper member is formed into a fence-like shape.

* * * * *